United States Patent [19]

Mendez

[11] 4,220,332

[45] Sep. 2, 1980

[54] BOWLING GAME

[76] Inventor: Guadalupe C. Mendez, 400 College Ave., Apt. 1207, Adrian, Mich. 49221

[21] Appl. No.: 940,732

[22] Filed: Sep. 8, 1978

[51] Int. Cl.[3] ..... A63D 3/00

[52] U.S. Cl. ..... 273/41; 273/118 R

[58] Field of Search ..... 273/37, 38, 39, 41, 273/48, 54 D, 118 R, 127 R, 127 D

[56] References Cited

U.S. PATENT DOCUMENTS

| | | | |
|---|---|---|---|
| 420,786 | 2/1890 | Habrecht | 273/41 |
| 1,251,442 | 12/1917 | Swindell | 273/41 |
| 1,568,852 | 1/1926 | Kohler et al. | 273/127 D |
| 1,623,518 | 4/1927 | Allen | 273/37 X |
| 1,742,702 | 1/1930 | Goodloe . | |
| 1,819,342 | 8/1931 | Shepherd | 273/39 |
| 2,626,153 | 1/1953 | Denney . | |
| 3,227,448 | 1/1966 | Groff . | |
| 3,306,614 | 2/1967 | Groff . | |
| 3,831,939 | 8/1974 | Lorber | 273/48 |
| 4,026,556 | 5/1977 | Taylor | 273/118 R |

*Primary Examiner*—Anton O. Oechsle

*Attorney, Agent, or Firm*—Beaman & Beaman

[57] ABSTRACT

A bowling game of inexpensive construction and simple rules particularly suitable for playing by the elderly and handicapped. A plurality of targets are pivotally suspended from a supporting frame, the targets pivoting upon being struck by a rolled ball. The frame includes a ball stop and ball retainer, and wing members pivotally mounted upon the frame are movable between a stored position within the frame configuration and an oblique permanently extending position to aid in guiding the balls into the frame. The frame also includes ball storage means, and a frame mounted target immobilizer bar is employed to hold the targets stationary during handling of the apparatus.

4 Claims, 5 Drawing Figures

BOWLING GAME

BRIEF SUMMARY OF THE INVENTION

The invention pertains to bowling games, and particularly relates to a bowling game utilizing pivotally supported targets.

Bowling games employing a plurality of targets are known, and it is also known to pivotally support the targets whereby impact of a ball upon the target will oscillate, pivot or tip over the target, and the target will be automatically restored to its original position after impact. U.S. Pat. Nos. 1,742,702; 2,626,153; 3,227,448 and 3,306,614 are examples of known prior art of this type.

It is an object of the invention to provide a bowling game utilizing pivotally mounted targets wherein the targets are pivotally supported from an overhead frame portion, and wherein the frame includes a backstop to limit ball movement as the balls pass the targets, or after the target is struck thereby.

A further object of the invention is to provide a bowling game of economical construction which utilizes a ball backstop and retaining means for trapping the ball after it is rolled toward the targets. The retaining means consist of pivotally mounted members capable of unidirectional pivotal action permitting the balls to enter the ball retaining chamber, and restraining ball movement therefrom.

Yet another object of the invention is to provide a bowling game particularly suitable for use by the elderly and handicapped wherein the target supporting frame includes wing members which may be obliquely extended toward the player to aid in directing rolled balls toward the frame and the ball retaining chamber. Also, the frame selectively supports a target immobilizer bar which holds the targets in a stationary condition for handling and storage purposes.

In the practice of the invention a generally U-shaped frame includes leg portions and a base portion adapted to be supported upon the floor. The base portion comprises a backstop against which balls rolled toward frame supported targets strike, and the outer ends of the leg portions support a bridge structure extending over the leg portions from which pivoted targets suspend. Intermediate the bridge portion and the base portion lies ball retaining means in the form of pivotally mounted elements suspended into the path of balls entering the frame, and stop means limit pivotal movement thereof unidirectionally to permit balls to enter a ball retaining chamber but not pass the elements in the opposite direction.

Adjacent each of the ends of the leg portions a wing member is pivotally mounted for oblique orientation to the associated leg portion in a forward direction for aiding in guiding balls rolled toward the targets into the frame. The pivotal mounting of the wing members permits the wing members to be pivoted to an inactive or stored position adjacent the leg portions, and latches mounted upon the frames retain the wing members in such stored condition.

The bowling game apparatus in accord with the invention can be readily manufactured of conventional wood components, and the game may be easily transported to recreation and playground areas for use as desired.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
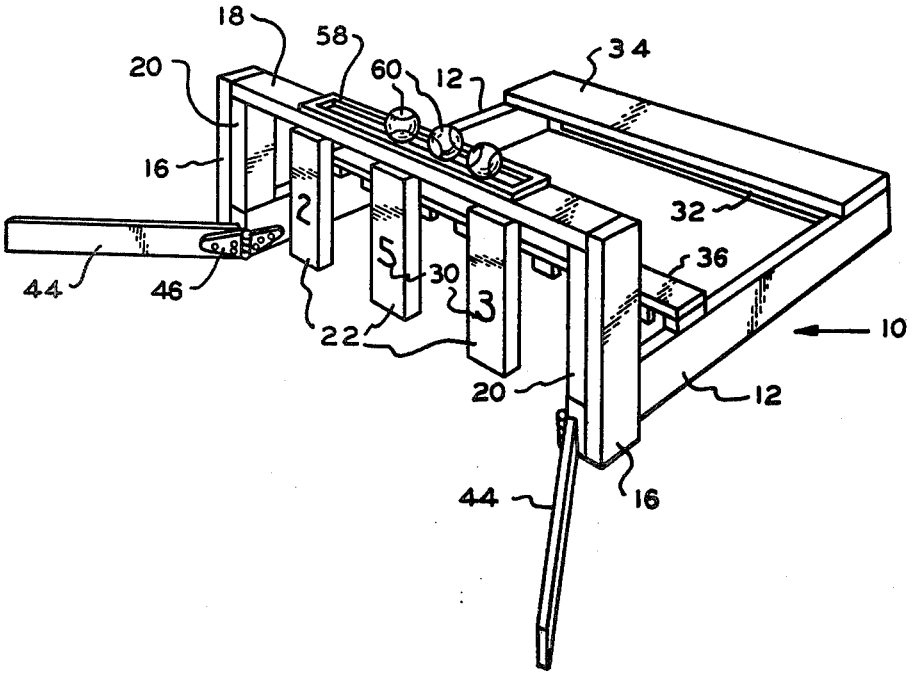
FIG. 1 is a front and side perspective view of a bowling game in accord with the invention in playing condition.

The construction of the bowling game in accord with the invention will be best appreciated from FIG. 1. In the disclosed embodiment the bowling game frame generally indicated at 10 is formed of wood components of conventional standard cross sectional dimension, and the frame consists of leg or side members 12 interconnected at one end by a base member 14. A pair of columns 16 are attached to the outer side of the side members adjacent their free ends and extend vertically upwardly to support the bridge member 18 which also includes column elements 20 rested upon the top of the associated side members 12.

Figure 3:
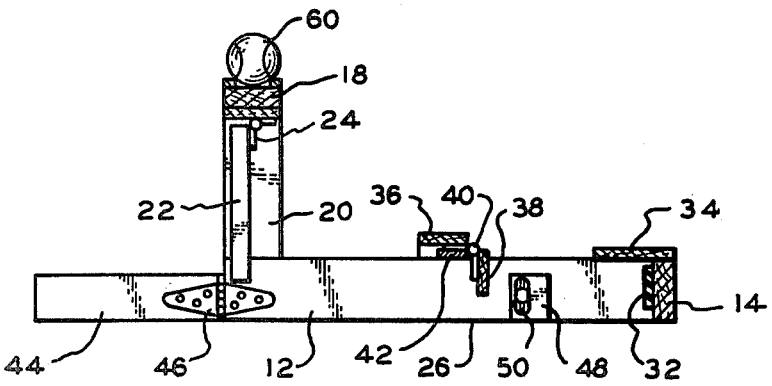
FIG. 3 is an elevational sectional view as taken along Section III—III of FIG. 2.

In the disclosed embodiment three targets 22 formed of two by fours, are pivotally connected to the underside of the bridge member 18 by hinges 24, FIG. 3. The targets 22 extend below the bridge member toward the floor upon which the frame 10 is resting, and terminate short of the plane of the side member supporting surfaces 26, but are close enough to the supporting floor as to be struck by balls, usually of softball size, as they are rolled toward the targets under the bridge member. The targets may have a bell 28, FIG. 4, attached to the backside thereof for audible indication of target movement upon being struck by a rolled ball, and numerical values may be assigned to the various targets for scoring purposes. Such numerical values may be indicated on the front surface of the targets as indicated at 30 in FIG. 1. Upon the targets being struck by a rolled ball the target will pivot and readily indicate the fact that it has been struck, and if a bell is attached thereto the resultant audible signal also indicates a "hit".

The inside surface of the base member 14 is provided with a cushioning strip 32 of felt or foam material so that as the balls are rolled toward the target and strike the base member the impact is cushioned. Also, a deflector board 34 is preferably attached to the side members 12 extending over the side members and base member to prevent upward deflection of the balls as they strike the base member.

Means for retaining the balls adjacent the base member includes a retainer support bar 36 affixed to the side members and extending thereover. The retainer bar 36 pivotally supports a plurality of ball retainers 38 which suspend below the retainer bar on hinges 40. A stop 42 is attached to the bar 36 in such a manner as to restrict rotation of the retainers 38 about their pivot axis in a clockwise direction as viewed in FIG. 3 whereby the retainers may readily rotate in a counterclockwise direction, FIG. 3 to permit a ball to pass thereunder, but after the ball has displaced a retainer and rolled thereunder it will resume the vertical position of FIG. 3 and the unidirectional pivoting of the retainer will prevent the balls from passing thereunder toward the targets after striking the base member. Of course, the retainers 38 are spaced apart a distance less than the diameter of the balls.

Figure 2:
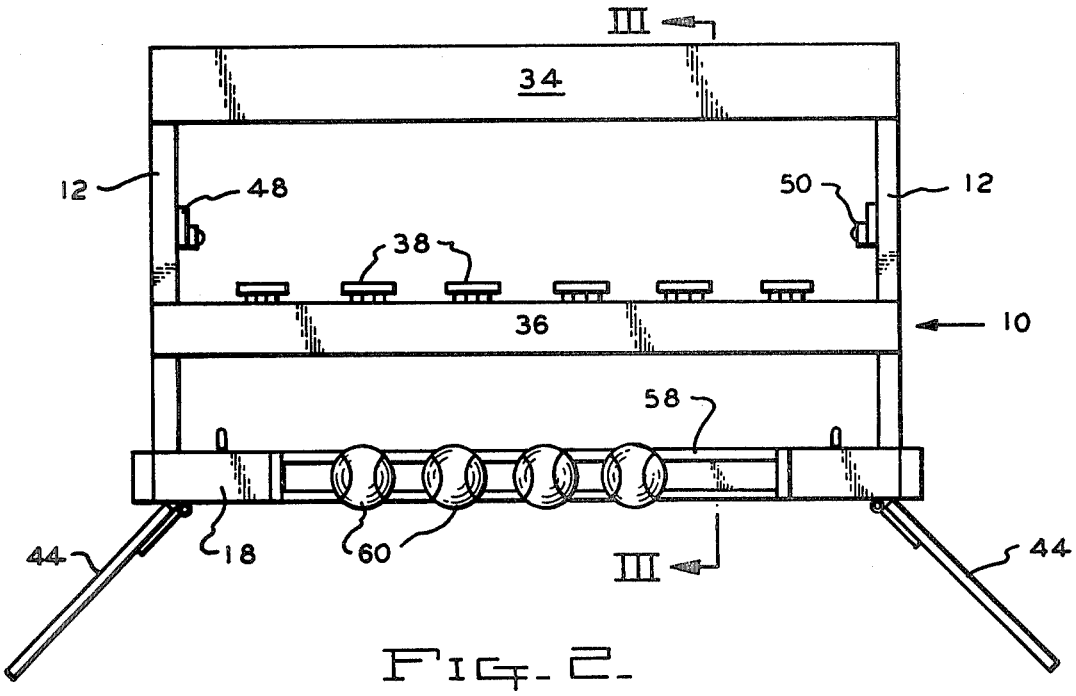
FIG. 2 is a top plan view of the bowling game in playing condition.

A wing member 44 is pivotally attached to the free end of each of the side members 12 by a hinge 46 whereby the wing member may be extended obliquely and forwardly as shown in FIGS. 1 and 2 to aid in deflecting balls into the confines of the frame. The hinged support of the wing members permits the wing members to be folded back adjacent the side members to the retracted position shown in FIGS. 4 and 5, and latch block 48 supporting a pivotal latch 50 is employed to overlap the ends of the wing members in the retracted position to maintain them in such position during handling or storage.

Figure 5:
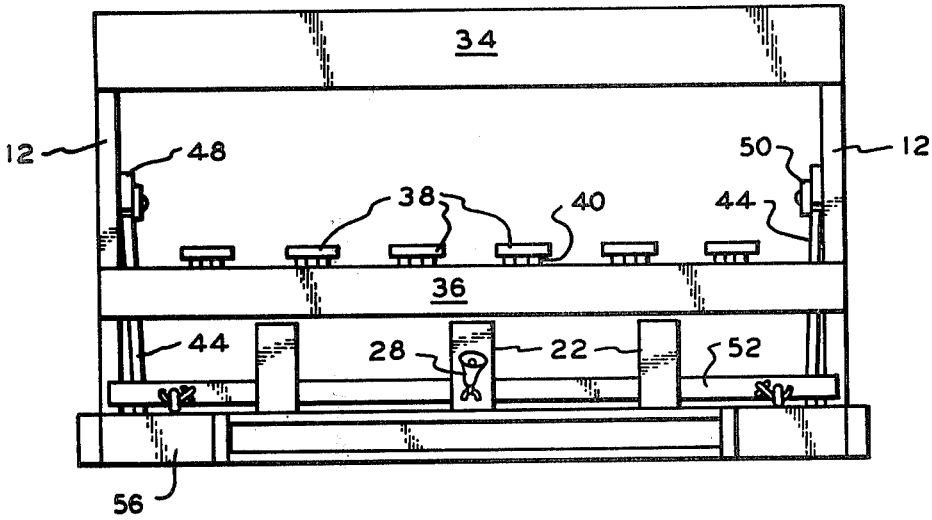
FIG. 5 is a top plan view of the bowling game in the stored condition of FIG. 4.
Figure 4:
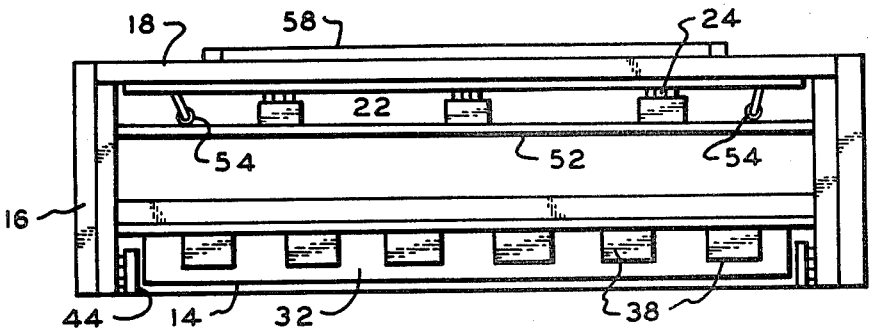
FIG. 4 is a front elevational view of the bowling game illustrating the components in the stored or handling condition.

The targets 22 may be immobilized by employing a immobilizer bar 52, FIGS. 4 and 5, which is attached to the backside of the bridge 18 by hooks and eyes 54. The immobilizer bar 52 holds the targets 22 in an upward pivoted direction pivoting the same up against the underside of the bridge, and with the targets so immobilized, and the wing members 44 latched as shown in FIGS. 4 and 5 is possible to readily carry the frame by grasping the base member 14 or the deflection board 34. Also, the frame may be readily stored by resting the same upon the column and bridge surfaces 56 as represented in FIG. 5.

A ball rack 58 may be defined upon the upper surface of the bridge member for supporting a plurality of balls 60 as used in the playing of the game.

To play the game the wing members 44 are folded to the position of FIGS. 1 and 2, and the immobilizer bar 52 is removed so that the targets pivot to the position of FIG. 1. The players stand in front of the frame and roll the ball toward the targets. Usually each player will roll three balls at a time, and score is kept by tabulation of the value of the targets struck.

It will be appreciated that the bowling game of the invention may be economically constructed, and it is of such a nature as to permit the handicapped and elderly to enjoy bowling without utilizing excessive energy. The trapping of the balls between the base member 14 and the retainer elements 38 minimizes ball retreival and the relatively simple construction permits games of this type to be widely available.

It is appreciated that various modifications to the inventive concepts may be apparent to those skilled in the art without departing from the spirit and scope of the invention.

I claim:

1. A bowling game comprising, in combination, a frame adapted to be supported upon a floor including a pair of spaced side members interconnected by a base member, said members defining a generally U-shaped configuration, said side members each including a front end and a rear end, said base member being affixed to said side members at said rear ends thereof, a wing member mounted upon each of said side member front ends extending forwardly and obliquely relative to the associated side member to define a ball guide, a hinge interconnecting said wing members to the associated side member front end, said wing members being pivoted between the extended forward and oblique position and a retracted position adjacent the associated side member, a retractable lock means defined on said side members selectively holding the associated wing member in the retracted position, a bridge member attached to said side member front ends vertically extending above and interconnecting said front ends, at least one target pivotally attached to said bridge member and depending therefrom a sufficient extent to permit being struck by a ball rolling on the floor under said bridge member, and unidirectional ball retaining means mounted on said side members intermediate said target and base member permitting balls rolled at said target to pass therethrough and preventing balls from passing therethrough in the opposite direction toward said target and side members front ends, said ball retaining means comprising a support member mounted on said side members and extending thereabove, a plurality of hinged members individually pivotally mounted on said support member and extending therebelow and stop limit means defined on said support member controlling the extent of pivoting of said each of hinged members.

2. In a bowling game as in claim 1, a cushion pad mounted on said base member to cushion the impact of balls engaging said base member.

3. In a bowling game as in claim 1, said bridge member including an upper surface, and a ball storage rack defined on said bridge member upper surface.

4. In a bowling game as in claim 1, a target immozilizer selectively mountable upon said bridge member for selectively holding said target in an immobilized condition during handling of said frame.

* * * * *